United States Patent [19]

Simm et al.

[11] Patent Number: 4,733,433

[45] Date of Patent: Mar. 29, 1988

[54] GRIP UNIT FOR A SUCTION HOSE OF A VACUUM CLEANER SYSTEM

[75] Inventors: Hans-Peter Simm; Peter Hannemann, both of Wuppertal, Fed. Rep. of Germany

[73] Assignee: Vorwerk & Co. Interholding GmbH, Wuppertal, Fed. Rep. of Germany

[21] Appl. No.: 933,917

[22] Filed: Nov. 24, 1986

[30] Foreign Application Priority Data

Dec. 3, 1985 [DE] Fed. Rep. of Germany ... 8533941[U]

[51] Int. Cl.[4] ..... H01R 4/64

[52] U.S. Cl. ..... 15/410; 15/377; 174/47; 439/194

[58] Field of Search ..... 15/377, 410; 174/47; 439/191, 194

[56] References Cited

U.S. PATENT DOCUMENTS

| | | | |
|---|---|---|---|
| 2,858,093 | 10/1958 | Knoll | 174/47 |
| 4,079,965 | 3/1978 | Moughty et al. | 174/47 X |
| 4,473,923 | 10/1984 | Neroni et al. | 174/47 X |
| 4,494,270 | 1/1985 | Ritzau et al. | 174/47 X |
| 4,652,063 | 3/1987 | Genoa et al. | 174/47 X |

*Primary Examiner*—Chris K. Moore

*Attorney, Agent, or Firm*—Walter Ottesen

[57] ABSTRACT

A grip unit for a suction hose of a vacuum cleaner system defines both air and electrical connections to further components of the system such as a suction pipe, nozzle and the like. The grip unit includes a one-piece insert member which is preassembled and then inserted into a tubular member. The one-piece insert member accommodates all electrical components or accessories and, in the inserted position, this insert member defines a sealed air guide and a channel for the electrical parts. The simplified configuration substantially simplifies assembly and reduces the cost to manufacture the unit.

7 Claims, 3 Drawing Figures

GRIP UNIT FOR A SUCTION HOSE OF A VACUUM CLEANER SYSTEM

FIELD OF THE INVENTION

The invention relates to a grip unit for a suction hose of a vacuum cleaner system. The air connection as well as the electrical connection with further components such as a suction tube, nozzle and the like are established with this grip unit.

BACKGROUND OF THE INVENTION

Such grip units appear in many variations with almost every modern vacuum cleaner, especially floor vacuum cleaners. These grip units are so configured that they include a lower part and an upper part which is attached to the latter. In this way, the lower part and the upper part provide an air conduit as well as possibilities for building in electrical components. When parts of this type are assembled, care must be taken that the air channel is well sealed with respect to the ambience. This makes assembly difficult and expensive.

SUMMARY OF THE INVENTION

In view of the above, it is an object of the invention to provide a grip unit for providing an air connection while at the same time providing an electrical connection. It is also an object of the invention to configure the unit so that it is simple to produce and provides a conduit for the air which is well sealed.

The grip unit according to the invention is for a suction hose of a vacuum cleaner system and for defining air and electrical connections to further components of the vacuum cleaner system such as a suction pipe, nozzle and the like, the grip. The grip unit includes a one-piece tubular member defining a longitudinal axis. An elongated insert member adapted for insertion into the tubular member has first and second longitudinal ends and electrical interconnection means for providing an electrical circuit between these ends. The insert member includes channel means for accommodating the electrical interconnection means. Air passage means are formed in the insert member for conducting air therethrough. Finally, the insert member includes sealing means for sealing the air passage means with respect to the ambience when the insert member is inserted into the tubular member.

The grip unit for the suction hose of a vacuum cleaner system achieves a conduction of air which is well sealed with respect to the ambience because of its closed and simple construction. In addition, the assembly of the grip unit is substantially simplified.

BRIEF DESCRIPTION OF THE DRAWING

The drawing will now be described wherein.

DESCRIPTION OF THE PREFERRED EMBODIMENTS OF THE INVENTION

Figure 1:
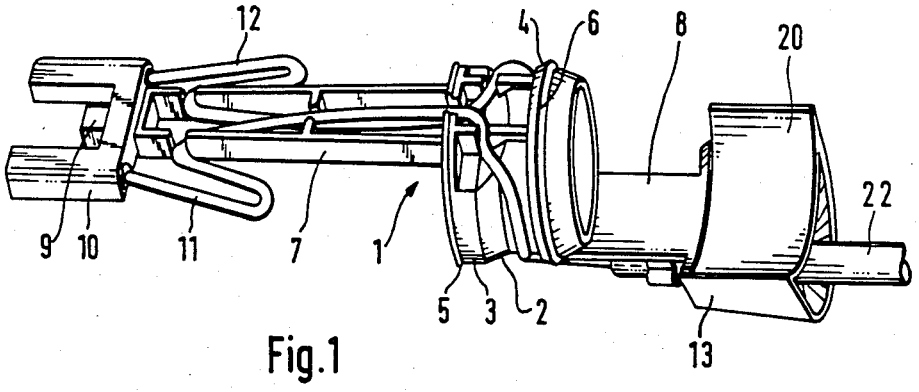
FIG. 1 is a perspective view of the insert member of the grip unit according to the invention.

Referring to FIG. 1, a central ring 2 has a forward edge 3 and a rearward edge 4 on which are provided respective peripheral sealing lips 5 and 6.

Two cable channels 7 and 8 are provided on respective longitudinal ends of the ring 2 and are displaced from each other by 180°. The cable channel 7 includes a plug 10 mounted at its end 9. The plug 10 lies loosely in the channel 7. The plug 10 can, for example, be used to establish an electrical connection to an accessory device attached to the left end of the grip unit. On the other hand, if the grip unit is attached to a suction hose, the plug 10 can establish an electrical connection to a suction pipe. A second hand grip on the far end of the suction pipe could then serve to connect an accessory device to the suction pipe.

Stranded conductors 11 and 12 are connected to the plug 10. These are then guided in cable channel 7 up to the central ring 2. At the ring 2, the two conductors 11 and 12 are separated and guided around the ring 2 and are brought together again in order to be guided in cable channel 8 to a protective housing 13. The appendage 24 (FIG. 2) on the ring 2 is provided only for the purpose of guiding the conductors. The housing 13 is formed as one piece and protects the cable 22 against bending when the grip unit is in use. The cable 22 conducts electrical energy from a vacuum cleaner power unit.

Figure 2:
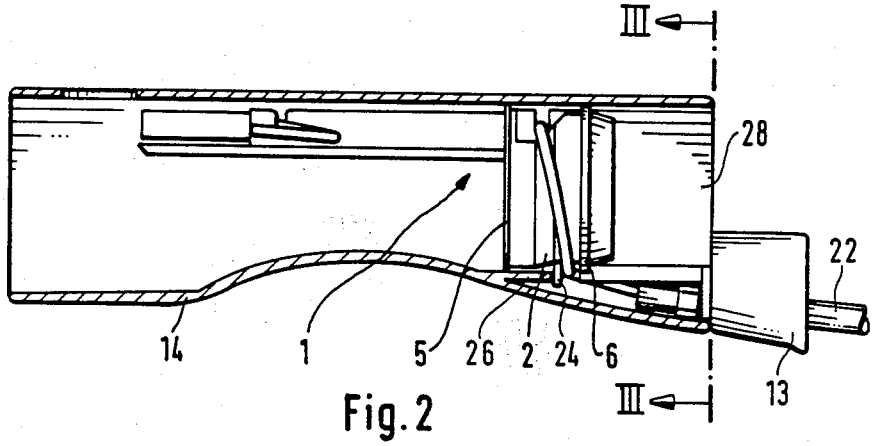
FIG. 2 is an elevation view, partially in section, of the tubular member showing the insert member of FIG. 1 mounted therein; and, FIG. 3 is an end view of the grip unit of the invention taken along line III—III of FIG. 2.

In this preassembled condition, the complete insert part 1 shown in FIG. 1 is inserted into the tubular member 14 wherein it appears as shown in FIG. 2. In FIG. 2, only the tubular member 14 is shown in section. With part 1 inserted in this manner, the central ring 2 forms the air guide which is in this way separated from the electrical parts. The sealing lips 5 and 6 assure that the air channel 28 is sealed with respect to the ambience. Reference numeral 26 identifies an inwardly extending wall portion of the tubular member 14. The wall portion 26 and the portion of the tubular member 14 thereabove conjointly define a circular wall section at this location.

Figure 3:
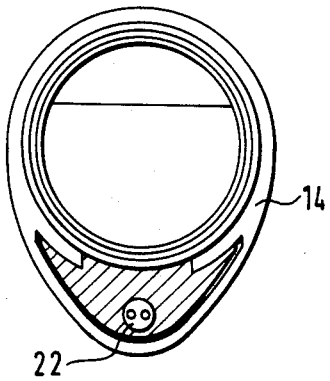

The production of the grip unit 1 is very substantially simplified since the insert part 1 is preassembled. The insert part 1 is than simply inserted into the tubular member 14 and secured. FIG. 3 shows an end view of the grip unit with the insert part 1 mounted in the tubular member 14.

A suction hose or suction pipe would be tightly connected to the grip unit at the right end thereof as viewed in FIG. 2. The grip unit according to the invention and the suction hose or suction pipe then conjointly constitute a part. The vacuum cleaner power unit is connected to this part. When the suction hose or suction pipe is connected to the grip unit, the suction hose or suction pipe is accommodated on the curved surface 20 of housing 13 and is arranged against the central ring 2.

It is understood that the foregoing description is that of the preferred embodiments of the invention and that various changes and modifications may be made thereto without departing from the spirit and scope of the invention as defined in the appended claims.

What is claimed is:

1. A grip unit for a suction hose or suction pipe of a vacuum cleaner system and for defining air and electrical connections to further components of the vacuum cleaner system such as a suction pipe, nozzle and the like, the grip unit comprising:

a one-piece tubular member defining a longitudinal axis;

an elongated insert member adapted for insertion into said tubular member and having first and second longitudinal ends; and, electrical interconnection means for providing an electrical circuit between said ends;

said insert member including:

channel means for accommodating said electrical interconnection means therein;

air passage means formed in said insert member for conducting air therethrough; and, sealing means for sealing said air passage means with respect to the ambience when said insert member is inserted into said tubular member.

2. The grip unit of the claim 1, said tubular member having an inner wall surface; and, said insert member including: a ring concentric with said tubular member and defining said air passage means through said insert member; said ring having an outer peripheral surface spaced from said inner wall surface and two longitudinal end faces; and, said sealing means including two mutually adjacent annular sealing lips formed on said outer peripheral surface for conjointly defining an annular channel and for contact engaging said inner wall surface in a seal-tight manner when said insert member is seated in said tubular member;

said channel means including a first channel extending in the direction of said axis from one of said longitudinal end faces of said ring and a second channel extending in the direction of said axis from the other longitudinal end face of said ring, said first and second channels communicating with said annular channel; and, said electrical interconnection means including electrical leads disposed in said first channel and extending through said annular channel into said second channel.

3. The grip unit of claim 2, said second channel being arranged next to an open end of said tubular member and being a sealed channel for holding said electrical heads therein.

4. The grip unit of claim 2, said first and second channels being displaced from each other by 180°.

5. The grip unit of claim 4, said electrical leads having a plug arranged in said first channel and said second channel including a protective housing at the outer end thereof for passing said leads from said second channel and said protective housing being configured to prevent bending of said leads when said grip unit is in use.

6. The grip unit of claim 5, said second channel and said protective housing being configured as single integral piece.

7. The grip unit of claim 4, said ring and said first and second channels being configured as a single integral piece.

* * * * *

UNITED STATES PATENT AND TRADEMARK OFFICE

CERTIFICATE OF CORRECTION

PATENT NO. : 4,733,433

DATED : March 29, 1988

INVENTOR(S) : Hans-Peter Simm and Peter Hannemann

It is certified that error appears in the above-identified patent and that said Letters Patent is hereby corrected as shown below:

In column 1, line 38: delete "like, the grip." and substitute -- like. -- therefor.

In column 2, line 45: delete "than" and substitute -- then -- therefor.

In column 3, line 16: delete "of the claim 1," and substitute -- of claim 1, -- therefor.

In column 4, line 13: delete "heads" and substitute -- leads -- therefor.

In column 4, line 23: delete "as single" and substitute -- as a single -- therefor.

Signed and Sealed this

Thirteenth Day of September, 1988

*Attest:*

DONALD J. QUIGG

*Attesting Officer*

*Commissioner of Patents and Trademarks*